US005114742A

United States Patent [19]

Branovich et al.

[11] Patent Number: 5,114,742

[45] Date of Patent: May 19, 1992

[54] METHOD OF PREPARING A SCANDATE CATHODE BY IMPREGNATING A POROUS TUNGSTEN BILLET WITH $BA_3AL_2O_6$, COATING THE TOP SURFACE WITH A MIXTURE OF $SC_6WO_{12}$,$SC_2(WO_4)_3$, AND W IN A 1:3:2 MOLE RATIO, AND HEATING IN

[75] Inventors: Louis F. Branovich, Howell; Gerard L. Freeman, Freehold; Donald W. Eckart, Wall, all of N.J.

[73] Assignee: The United States of America as represented by the Secretary of the Army, Washington, D.C.

[21] Appl. No.: 731,601

[22] Filed: Jul. 17, 1991

[51] Int. Cl.[5] ..... B05D 5/12

[52] U.S. Cl. ..... 427/77; 427/126.3; 427/295; 427/376.4; 445/50; 445/51

[58] Field of Search ..... 427/77, 126.3, 295, 427/356, 376.4; 445/50, 51

[56] References Cited

U.S. PATENT DOCUMENTS

| | | | |
|---|---|---|---|
| 2,869,017 | 10/1956 | Levi | 445/51 |
| 4,236,287 | 6/1979 | Smith | 445/51 |
| 4,273,683 | 6/1981 | Kawamura | 445/51 |
| 5,041,757 | 8/1991 | Longo et al. | 427/77 |

OTHER PUBLICATIONS

S. Yamamoto, S. Taguchi, I. Watanabe and S. Kawase; "Impregnated cathode Coated with Tungsten Thin Film Containing $Sc_2O_3$", J.Vac. Sci. Technol.A5(4), Jul./Aug. 1987, pp. 1299–1302.

E. S. Rittner, W. C. Rutledge, and R. H. Ahlert, "On the Mechanism of Operation of the Barium Aluminate Impregnated Cathode", Journal of Applied Physics, vol. 28, No. 12, Dec. 1957, pp. 1468–1473.

*Primary Examiner*—Shrive Beck
*Assistant Examiner*—Benjamin L. Utech
*Attorney, Agent, or Firm*—Michael Zelenka; Roy E. Gordon

[57] ABSTRACT

An improved scandate cathode having an increased emission density is prepared from a porous tungsten billet that has been impregnated with $Ba_3Al_2O_6$ by coating the top surface of the impregnated billet with a mixture of $Sc_6WO_{12}$,$Sc(WO_4)_3$, and W in the mole ratio of 1:3:2, heating the billet to about 1000° C. in a vacuum to cause $BaWO_4$ and Sc to form in the billet in a molar ratio of 1:1, removing the billet and cleaning in a jewelers lathe, and preparing the billet for a cathode environment.

3 Claims, No Drawings

METHOD OF PREPARING A SCANDATE CATHODE BY IMPREGNATING A POROUS TUNGSTEN BILLET WITH $BA_3AL_2O_6$, COATING THE TOP SURFACE WITH A MIXTURE OF $SC_6WO_{12}$,$SC_2(WO_4)_3$, AND W IN A 1:3:2 MOLE RATIO, AND HEATING IN

GOVERNMENT INTEREST

The invention described herein may be manufactured, used, and licensed by or for the Government for governmental purposes without the payment to us of any royalty thereon.

FIELD OF INVENTION

This invention relates in general to a method of preparing an improved scandate cathode in which a porous tungsten billet is impregnated with $Ba_3Al_2O_6$ and in particular to such a method wherein $BaWO_4$ and scandium are formed on the billet in a molar ratio of 1:1.

BACKGROUND OF THE INVENTION

Heretofore, it has been known to prepare a scandate cathode by impregnating a porous tungsten billet with a barium emitter such as $Ba_3Al_2O_6$; then, placing $Sc_2(WO_4)_3$ on top of the impregnated billet and then heating to form free barium in the impregnated billet. The free barium is formed according to the reaction $$2Ba_3Al_2O_6 + W \rightarrow 2BaAl_2O_4 + BaWO_4 + 3Ba$$

The free barium atoms that are generated migrate to the surface of the billet and react there with the $Sc_2(WO_4)_3$ coating according to the reaction $$3Ba + Sc_2(WO_4)_3 \rightarrow 3BaWO_4 + 2Sc$$

The difficulty in the above reaction is that Sc and $BaWO_4$ form in the mole ratio of 2:3. If the molar ratio of $BaWO_4$ to Sc is 3:2, then two $BaWO_4$ is interacting with 2Sc with 1$BaWO_4$ not interacting. Since five molecules are present (3$BaWO_4$ and 2 Sc) and only four can interact (2 $BaWO_4$ with 2Sc) then 1/5 or 20 percent of the surface is idle or inert.

SUMMARY OF THE INVENTION

The general object of this invention is to provide a method of making an improved scandate cathode. A more particular object of the invention is to provide such a method wherein 100 percent dipole interaction is obtained at the surface of the billet and therefore more emission.

It has now been found that the foregoing objects can be attained by impregnating a porous tungsten billet with $Ba_3Al_2O_6$, coating the top surface of the impregnated billet with a mixture of $Sc_6WO_{12}$, $Sc_2(WO_4)_3$ and W in the mole ratio of 1:3:2, heating the billet to about 1000° C. in a vacuum to cause $BaWO_4$ and Sc to form in the billet in the molar ratio of 1:1, removing the billet and cleaning the coated billet in a jewelers' lathe and preparing the billet for a cathode environment.

The invention is believed to work because the emission of the scandate cathode is a function of the layered ordering of Ba-Sc-O on the surface. With a 1:1 ratio of Sc:$BaWO_4$, more order is given to the surface layer.

The impregnated billet that has been prepared for a cathode environment becomes a cathode once heat is applied to the billet and sufficient heat energy is applied to drive electrons from the surface of the billet. A cathode is a material that emits electrons when energy such as heat is applied to it. The top portion of this cathode is considered scandate.

In the method of the invention, the heating of the billet to about 1000° C. in a vacuum causes the following to occur. Initially, $Sc_6WO_{12}$ reacts with the 2 moles of W to form 1 mole of $Sc_2(WO_4)_3$ and 4 moles of Sc. To this mixture is added the 3 moles of $Sc_2(WO_4)_3$ giving a total of 4 moles of $Sc_2(WO_4)_3$ and 4 moles of Sc. When 12 moles of Ba is added to the above mixture, 12 moles of $BaWO_4$ are generated together with 8 moles of Sc. Since there are 4 moles of Sc present due to the reaction of $Sc_6WO_{12}$ with 2 moles of W, the total Sc present is 12 moles. The molar ratio of the $BaWO_4$ and Sc is then 12:12 or 1:1.

DESCRIPTION OF THE PREFERRED EMBODIMENT

A porous tungsten billet is impregnated with $Ba_3Al_2O_6$. The top surface of the inpregnated billet is then coated with a mixture of $Sc_6WO_{12}$, $Sc_2(Wo_4)_3$ and W in the mole ratio of 1:3:2. The billet is then heated to about 1000° C. in a vacuum to cause BaWO and Sc to form in the billet in the molar ratio of 1:1. The billet is then removed, cleaned in a jewelers lathe, and prepared for a cathode environment.

The billet is conveniently prepared for a cathode environment by placing the billet and an anode in a vacuum and heating the billet. As the billet is heated in the vacuum, the billet acts as a cathode and emits electrons from its surface. These electrons pass through the vacuum onto the anode and then pass through the system to complete the circuit.

The method for the invention is also applicable to the manufacture of rare earth cathodes such as neodymiate and lanthanate cathodes and also scandate cathodes partially substituted with rare earth elements such as $La_{0.3}Sc_{0.7}$ cathode.

The stoichiometric ratio of lanthanum or other rare earths can be substituted for scandium by using as an example $SC_6WO_{12}$. Here, the subscript on the scandium is 6 in this compound. If a molar ratio of 3 parts rare earth and seven parts of scandium wee mixed, the compound would be $La_{0.3\times 6}$ $Sc_{0.7}x6WO_{12}$ or $La_{1.8}Sc_{4.2}WO_{12}$. The total subscript for the metal portion is 1.8+4.2 or 6.0 that is identical to the 6 in the subscript Sc WO.

What is claimed is:

1. Method of preparing a scandate cathode having an increased emission density from a porous tungsten billet that has been impregnated with $Ba_3AL_2O_6$ including the steps of
   - (A) coating the top surface of the impregnated billet with a mixture of $Sc_6WO_{12}$, $SC_2(WO_4)_3$, and W in the mole ratio of 1:3:2,
   - (B) heating the billet to about 1000° C. in a vacuum to cause $BaWO_4$ and Sc to form in the coated billet in a mole ratio of 1:1,
   - (C) removing the coated billet and cleaning in a jewelers lathe, and
   - (D) preparing the billet for a cathode environment wherein heat is applied to the coated billet to drive electrons from the surface of the coated billet and to act as a scandate cathode.

2. Method according to claim 1 wherein the scandate cathode is partially substituted with a rare earth element.

3. Method according to claim 2 wherein the scandate cathode partially substituted with rare earth in $La_{0.3}Sc_{0.7}$.

* * * * *